United States Patent [19]

Kubacki

[11] Patent Number: 4,519,410

[45] Date of Patent: May 28, 1985

[54] TENT CONSTRUCTION

[76] Inventor: Steven R. Kubacki, 33 Mountain Rd., South Deerfield, Mass. 01373

[21] Appl. No.: 541,861

[22] Filed: Oct. 14, 1983

[51] Int. Cl.[3] ..... A45F 1/00; A45F 1/10

[52] U.S. Cl. ..... 135/93; 135/95; 135/97

[58] Field of Search ..... 135/93, 94, 95, 96, 135/97, 115

[56] References Cited

U.S. PATENT DOCUMENTS

| | | | |
|---|---|---|---|
| 487,319 | 12/1892 | Davis | 135/93 X |
| 1,856,658 | 5/1932 | Rummler | 135/93 |
| 2,345,377 | 3/1944 | Bowen | 135/93 X |
| 2,540,529 | 2/1951 | Johnson | 135/97 |
| 3,441,037 | 4/1969 | Transeau | 135/102 X |
| 3,621,858 | 11/1971 | Steele | 135/93 X |
| 3,943,952 | 3/1976 | Marquart et al. | 135/93 |

*Primary Examiner*—Robert A. Hafer
*Assistant Examiner*—Arnold W. Kramer
*Attorney, Agent, or Firm*—Robert B. Watkins

[57] ABSTRACT

A portable tent construction in which an outer tent of see-through "mosquito net-like" material completely encloses an inner waterproof weather tent which can be erected by the occupant from within the outer tent without the inconvenient necessity of exiting the tent. Implementation is uncomplicated and may be partially or totally completed as desired.

7 Claims, 4 Drawing Figures

TENT CONSTRUCTION

BACKGROUND OF THE INVENTION

This invention relates to a means of construction for portable tents whereby an inner waterproof tent is contained within an outer "open-air" tent. More specifically, it relates to an outer tent comprised mainly of "mosquito net" open mesh fabric which is assembled and combined with an easily deployed inner tent of nylon, canvas, or similar material affording the user with easily erected protection in adverse weather conditions.

In the history of portable tents, as well as most other temporary shelters, provisions for "open-air" enclosures as an attachment within more protective materials is well known. In the past, when it is desired that the heavier "weather tent" material be put in place, it has been the conventional and usual practice for the tent user to exit the structure to secure the covering. Various methods for securing this outer covering have been presented with varying degrees of success.

Typically, tents have been constructed of canvas, made from cotton or other natural fiber, or nylon from a polyester or other man made fiber, which is woven tightly to provide a more or less weather impervious enclosure surface or wall. In more resent years, with greater emphasis on naturalism, fabrics for this purpose have become lighter in weight with the objective of not sacrificing the weather proof qualities of prior heavy canvas materials. When fabrics are made "weather proof" by tight weaving, the passage of air is restricted through the fabric so that tents constructed of very tight materials tend to be stuffy and warm inside because of the lack of air movement, unless they are provided with openings.

It is the usual practice to provide such openings and to cover the openings with an open mesh screen-like material, sometimes called mosquito netting. U.S. Pat. No. 1,198,773—Robinson, shows such a typical opening and also discloses the further usual practice of providing an additional piece of the weather material, sometimes called a "fly", to cover the open mesh material in the event of rain or other inclement weather. By these coverings for the openings, the necessary versatility is provided.

U.S. Pat. No. 3,621,857—R. L. May et al. and U.S. Pat. No. 1,704,945—Lefert, disclose other examples of the typical prior art technique of combining open mesh coverings for tent apertures and covering drapes or flys for weather protection and privacy.

U.S. Pat. No. 4,102,352—Kirkham, reveals a tent structure combining inner and outer fabrics with an air space between in which each of the inner and outer fabrics are relatively close knit for weather and enclosure purposes, the air space between having the purpose of providing insulation against either a cold or hot temperature differential between the outside air and that desired within the tent.

All of these prior approaches to the problems of providing versatility in the circumstance when the outer fly closer must be fastened, and the weather has turned inclement so that it is raining and storming, require that the camper exit the tent to put the protective material in place. Most all campers will recall the experience of fumbling around in the rain while snapping or tying the weather fly into place.

U.S. Pat. No. 3,621,858—Steele and U.S. Pat. No. 3,441,037—Transeau, show tent constructions in which an outer weather tent covers an inner "open-air, see-through" mesh inner tent. In the Transeau patent the outer tent is erected from the outside while in the Steele patent a draw string and eye arrangement is provided to pull the weather fly into place over the open mesh tent from a position within the open mesh tent. While this accomplishes the result of eliminating the need to exit the tent, it continues the practice of covering the mesh from the outside. It also requires a certain amount of extra set-up procedures and complications.

Other tents exist which include "open-air, see-through" mesh as the outer walls but which ignore the circumstance of inclement weather. Such tents are promoted for use in dry "desert-like" conditions.

SUMMARY OF THE INVENTION

Briefly and in summary, this invention is comprised of an outer tent of conventional design with side walls and end walls constructed of an open mesh material resistant to penetration by mosquitos and other insects or pests and having a waterproof ground covering bottom attached to the upper open mesh top. It is supported at either end by aluminum A-frames secured by guy-lines to stakes and anchored at each of four corners by ground pegs. Permanently attached to the interior of one of the side walls of the outer tent is a second inner tent which is stored in a rolled-up condition until needed. It may then be unrolled and attached at its apex to suspension hooks provided above the camper, and then secured to the side walls of the outer tent by means of zippers on three sides. A weather flap is provided to prevent water from seeping through the zippers, leaving the camper warm and dry with a minimum of inconvenience and effort.

It is a purpose of this invention to provide a convenient method of allowing the user of a portable tent to enjoy open-air camping while providing an effective waterproof covering should the need arise. It is a feature of the invention that this can be accomplished in a simple and uncomplicated procedure under any and all circumstances.

The foregoing and other advantages of the invention will become apparent from the following disclosure in which a preferred embodiment of the invention is described in detail and illustrated in the accompanying drawing. It is contemplated that variations and structural features and arrangement of parts may appear to the person skilled in the art, without departing from the scope or sacrificing any of the advantages of the invention.

DETAILED DESCRIPTION OF THE INVENTION

Figure 1:
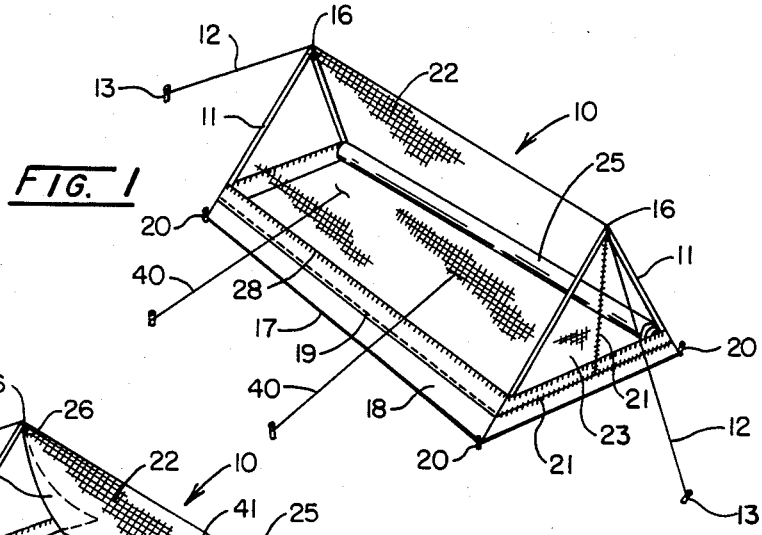
FIG. 1 is a perspective view of an outer tent of this invention in erected condition with a weather tent rolled up along one side.

In FIG. 1, an outer tent 10 of this invention is shown erected with an A-frame support means 11, preferably constructed of light weight metal such as aluminum, in place at both ends. Guy-lines 12 are attached at the pinnacle of the support means 11 and stretched taut to a ground peg 13. The outer tent is constructed of open mesh screen-like material at both side walls 22 and end walls 23. The outer "mosquito net" tent 10 is attached to and suspended by support cords 16 to a pinnacle of the support means 11, thereby maintaining the outer tent 10 in an erected position.

A waterproof bottom 17 rests upon a substrate such as the ground. The bottom 17 with upstanding border elements 18 is fastened to the side walls 22 and end walls 23 of the outer tent 10 at a first lower edge by sewing along a connection line 19 a portion of the distance up the border elements 18. Each of the four corners of the bottom 17 are secured by ground pegs 20 and held in a taut condition. The bottom 17 may be omitted with the border elements 18 pegged directly to the ground.

An end opening zipper 21 is shown at one end wall 23 of the outer tent 10 to provide an entrance. Of course, the other end may have a similar entrance/exit also. Thus, the structure created is of a well-known triangular four-sided apex A-frame configuration.

Connected to a border element 18 on a side wall 22 is a weather tent fly 25, preferrably rolled up and resting on the bottom 17. In its undeployed position shown, the weather tent fly 25 is rolled but it could be folded accordion style or in another position occupying a minimum space.

When the outer tent 10 is erected as shown in FIG. 1, the structure is relatively open because of the mesh fabric from which the tent walls 22 and 23 are constructed. Air-breezes may pass readily through, and occupants within the tent or observers outside the tent may see what is happening on the other side in the opposite position. When the weather is good and comfortable, occupants may enjoy the "outdoors" to a large degree, almost approximating the experience of sleeping out under the stars and the pleasures thereof.

Figure 2:
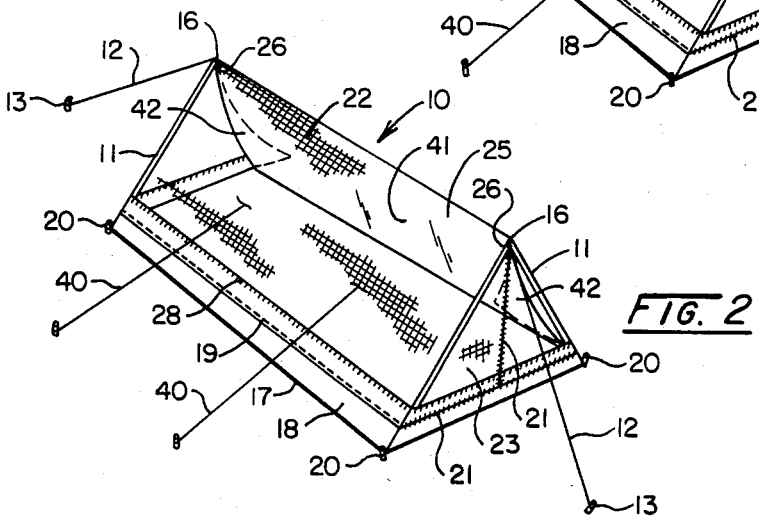
FIG. 2 is a perspective view of the outer tent with the weather tent erected to the apex for use as a sun shade on one side.
Figure 4:
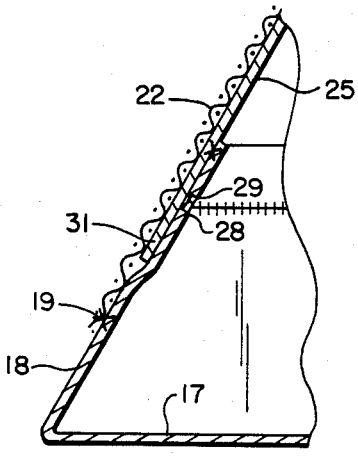
FIG. 4 is an enlarged cross section through the bottom to wall connection of the outer and inner tents.

Referring to FIGS. 2 and 4 also, an upper edge of the border element 18 is provided with fastening means, preferrably a zipper edge 28, which is attached continuously around three sides not occupied by the weather tent fly 25. A matching zipper edge 29 extends entirely around the edge of the weather tent fly 25, for connection to the zipper edge 28, as will be later explained. When the occasion arises, at the desire of the occupant of the outer tent 10, the weather tent fly 25 is unfurled or deployed upward along one side 22 of the outer tent 10 to the apex where it attaches to an anchor 26 with fastening means, such as through an eyelet on the edge, or by an elastic cord, for example.

In this erection position, the erected portion of the fly 25 acts as a sun and wind shield, having many of the aspects of a "lean-to", which will be familiar to most campers. In this position fly 25 will ward off the direct rays of the sun providing shade within the enclosure without obstructing breezes.

Wnen the tent 10 is deployed in the arrangement of FIG. 2, additional material 41 not required for the "lean to" side, is tied back parallel to that side. Folded end flaps 42 may be tucked in between the sides 25 and 41.

Figure 3:
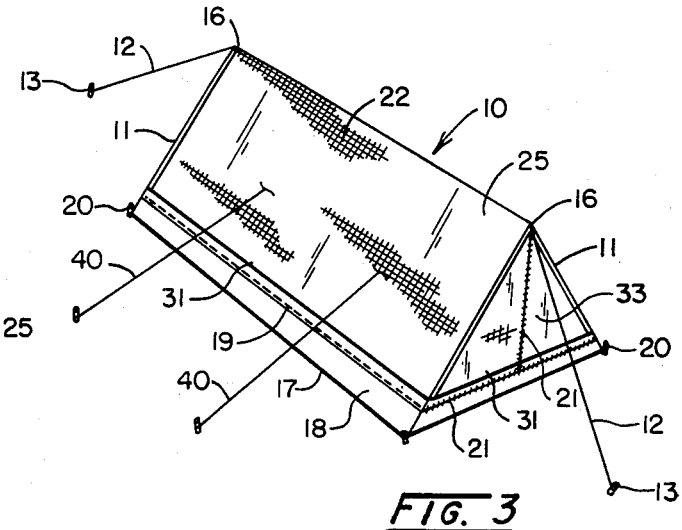
FIG. 3 is a perspective view of the outer tent with the weather tent erected within and in its completely weather proof condition.

Referring to FIG. 3, in the event of inclement weather or even to prevent the moisture of a morning dew from settling on the occupants of the tent 10, the remainder of the weather fly 25 is unfurled or deployed on the other side and the zipper edge 28 is connected to the zipper edge 29 by zipping at a second lower edge all around the border element 18. Because the fly 25 makes connection to the border element 18 within the outer tent wall, as mostly clearly seen in FIG. 4, connection can be made completely from within the inner and outer tents and without exiting. In a small one or two person triangular tent, such as that shown in FIGS 1–4, this may be accomplished simply by sitting up and without climbing out of the sleeping bag or other sleeping material. As shown in FIG. 4, an overlapping edge 31 extends over the enclosed zipper edges 28, 29 making the enclosure weather tight from the outside and accessible from the inside.

Referring again to FIG. 3, an end closure 33 or 42 may be provided in one or both end walls 23 leaving access to the interior as necessary and desirable.

Additional guy lines 40 may be added at various places on the tent walls to pull the sides out with more tension and provide more room inside. The weather tent 25 may be tied to the outer tent 10 at additional places to create greater tension and pull the sides out.

The tent construction means is shown as it relates to a well known triangular four sided apex A-frame type of tent, but of course there are many other shapes of tents including those shown in the references cited above. The tent construction of this invention is equally applicable to other shapes and should not be considered referring only to the preferred embodiment as revealed in this disclosure. Pyramid, umbrella, cabana, etc. type shapes could equally be constructed having an outer open mesh tent and an inner weather fly/tent where the advantages of the invention can be used.

Without departing from the spirit of this invention, various means of fastening the material together may be used, including the zippers shown, eyelets, snaps and snap buttons, and sewing or plastic heat sealing may be employed.

It is therefore understood that although the present invention has been specifically disclosed with the preferred embodiment and examples, modifications to the design concerning sizing and shape may be apparent to those skilled in the art, and such modifications and variations are considered to be within the scope of the invention and the appended claims.

What is claimed is:

1. A tent comprising when erected:

a. an open mesh of screen-like material enclosure of interconnected side walls and end walls forming a tent, fastened at a first lower edge to a border element constructed to be fastened to a substrate, such as the ground;

b. a weather resistant enclosure of interconnected side walls, end walls, and having a second lower edge, said walls erectable as a tent within the open mesh enclosure by connection and support means within the open mesh enclosure, the second edge of the weather resistant enclosure being fastenable to the border element; and c. a frame means for supporting the enclosures in erected position.

2. A tent according to claim 1 wherein the border is connected to a moisture resistant material forming a bottom for the enclosures.

3. A tent according to claim 1 wherein the open mesh material of the outer enclosure is of the anti-mosquito net type.

4. A tent according to claim 1 wherein the weather resistant enclosure is storable within the open mesh enclosure in unerected condition and is erectable within the open mesh enclosure by manipulation by an occupant of the open mesh enclosure while the occupant remains within the enclosures by joining the weather resistant enclosure to said connection and support means within said open mesh enclosure.

5. A tent according to claim 1 wherein the weather resistant enclosure is connected to the border element by zipper means.

6. A tent according to claim 5 wherein the open mesh material in the open mesh enclosure is sewn or sealed to the border at a position beyond the edge of the border leaving an extension on the border having a zipper side which is connectable to a second zipper side that is fastened to the weather resistant enclosure at a position leaving a flap over the zipper and beneath the open mesh enclosure.

7. A tent according to claim 1 of the triangular four sided apex A-frame configuration with ends that are triangular, in which the weather resistant enclosure is erectable by unfurling up one side while making a connection to the open mesh enclosure at the apex and unfurling down the other side, followed by connection to the border at the opposite side and ends.

* * * * *